US007578706B2

(12) United States Patent
Wang

(10) Patent No.: US 7,578,706 B2
(45) Date of Patent: Aug. 25, 2009

(54) ELECTRICAL CONNECTOR WITH ANTI-MISMATING MECHANISM FOR PREVENTING INCORRECT INSERTION OF A SMALLER SIZED MATING CONNECTOR

(75) Inventor: Ning Wang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/157,625

(22) Filed: Jun. 11, 2008

(65) Prior Publication Data

US 2008/0305663 A1 Dec. 11, 2008

(30) Foreign Application Priority Data

Jun. 11, 2007 (CN) ..... 2007 2 0039793

(51) Int. Cl.
*H01R 24/00* (2006.01)

(52) U.S. Cl. ..... 439/676

(58) Field of Classification Search ..... 439/676
See application file for complete search history.

(56) References Cited

U.S. PATENT DOCUMENTS 6,368,160 B2 * 4/2002 Chang ..... 439/676
6,375,516 B1 * 4/2002 Trinh ..... 439/680
6,416,364 B1 * 7/2002 Shi et al. ..... 439/680
6,517,386 B2 * 2/2003 Sakakura et al. ..... 439/676
6,579,128 B1 * 6/2003 Wu ..... 439/676
6,612,856 B1 * 9/2003 McCormack ..... 439/188
6,769,936 B2 * 8/2004 Gutierrez et al. ..... 439/676
7,108,563 B2 * 9/2006 Sato et al. ..... 439/676
7,125,288 B2 * 10/2006 Schilling ..... 439/676
2001/0049233 A1 * 12/2001 Sakakura et al. ..... 439/676
2005/0009410 A1 * 1/2005 Cheng et al. ..... 439/676
2005/0254223 A1 * 11/2005 Hashim et al. ..... 361/793
2006/0128227 A1 * 6/2006 Huang ..... 439/676
2007/0117469 A1 * 5/2007 Caveney et al. ..... 439/676
2007/0254529 A1 * 11/2007 Pepe et al. ..... 439/676
2007/0259571 A1 * 11/2007 Chen ..... 439/676
2008/0305663 A1 * 12/2008 Wang ..... 439/135
2008/0311798 A1 * 12/2008 Wang ..... 439/676
2009/0017696 A1 * 1/2009 Wang ..... 439/676

* cited by examiner

*Primary Examiner*—Ross N Gushi
(74) *Attorney, Agent, or Firm*—Wei Te Chung

(57) ABSTRACT

An electrical connector (100) for permitting insertion of a full sized plug and preventing insertion of a smaller sized plug includes an insulative housing (1) defining a receiving cavity (110) through a mating face (11) thereof for receiving a mating connector and a plurality of terminals (2) received in the housing. Each terminal defines a fixing portion (20) retained in the housing, a contacting portion (21) being inclinedly bent at an angle and extending into the receiving cavity from one end of the fixing portion and a soldering portion (22) extending from the other end of the fixing portion. The fixing portion further defines a supporting portion (23) with two ends connecting with the fixing portion, the supporting portion faces to and supports the contacting portion to prevent the contacting portion from further excursion.

10 Claims, 5 Drawing Sheets

ELECTRICAL CONNECTOR WITH ANTI-MISMATING MECHANISM FOR PREVENTING INCORRECT INSERTION OF A SMALLER SIZED MATING CONNECTOR

BACKGROUND OF THE INVENTION

1. Field of the Invention

The present invention relates to an electrical connector, and especially to a modular jack designed to prevent improper insertion of a smaller sized plug connector.

2. Description of the Prior Art

RJ-11 and RJ-45 receptacles respectively engaging with corresponding RJ-11 and RJ-45 plugs are commonly used in network communications. RJ-45 receptacles and plugs have larger dimensions than RJ-11 receptacles and plugs. Therefore, an RJ-11 plug or any smaller sized RJ type plug may be inadvertently inserted into an RJ-45 receptacle, which may result in damage to the terminals of the RJ-45 receptacle.

US Pat. Publication No. 2005/0009410 A1 discloses a receptacle connector having means to prevent incorrect insertion of a smaller sized plug so as to protect terminals of the receptacle connector. The receptacle connector includes an insulative housing and a plurality of terminals received in the housing. The housing defines a receiving cavity for receiving a mating plug through a front face thereof, and each terminal defines a horizontal fixing portion fixed in a bottom surface of the housing, an elastic contacting portion extending rearwards at an acute angle from a front end of the fixing portion, a supporting portion extending vertically and upwardly from a rear end of the fixing portion and a Z-shaped soldering portion extending rearwards from an upper end of the supporting portion. When an undersized plug is inserted into, the contact portions deform elastically and abut against the supporting portions, thereby preventing further insertion of the undersized plug.

But the supporting portion is just a vertical metal piece, and a larger insertion force of the undersized plug may make the metal piece deformed and destroyed so that the supporting portion can not support the contacting portion any more. Hence, a new design which can prevent incorrect insertion of a smaller sized mating connector is required.

SUMMARY OF THE INVENTION

Accordingly, an object of the present invention is to provide an electrical connector with simple anti-mismating mechanism for preventing an improper insertion of an undersized mating connector.

In order to achieve the object set forth, an electrical connector for permitting insertion of a full sized plug and preventing insertion of an undersized plug includes an insulative housing defining a receiving cavity through a mating face thereof for receiving a mating connector and a plurality of terminals received in the housing. Each terminal defines a fixing portion retained in the housing, a contacting portion being inclinedly bent at an angle and extending into the receiving cavity from one end of the fixing portion and a soldering portion extending from the other end of the fixing portion. The fixing portion further defines a supporting portion with two ends connecting with the fixing portion, the supporting portion faces to and supports the contacting portion to prevent the contacting portion from further excursion.

Other objects, advantages and novel features of the invention will become more apparent from the following detailed description of the present embodiment when taken in conjunction with the accompanying drawings.

DETAILED DESCRIPTION OF THE INVENTION

Figure 1:
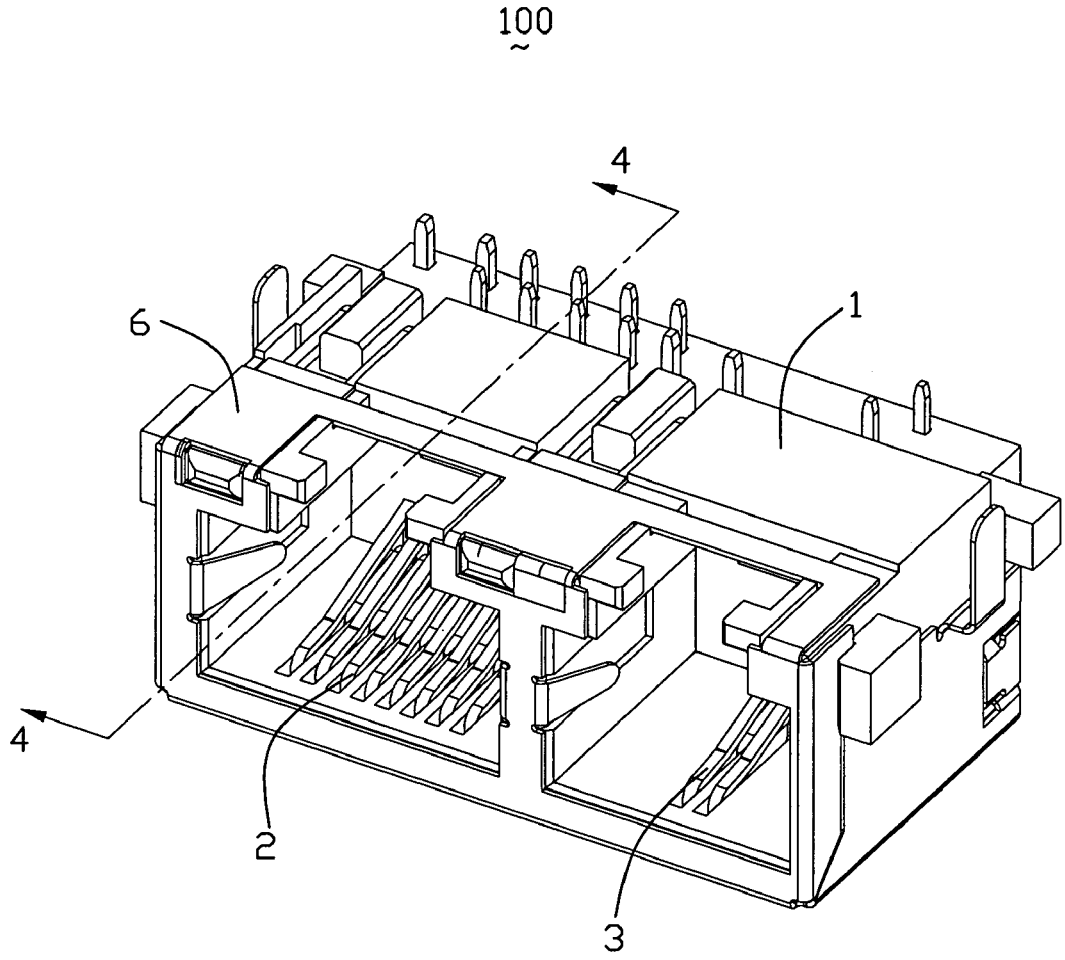
FIG. 1 is an assembled perspective view of an electrical connector in accordance with a preferred embodiment of the present invention.

Reference will now be made to the drawing figures to describe a preferred embodiment of the present invention in detail.

Referring to FIG. 1, the electrical connector 100 described in this preferred embodiment is a receptacle connector. The electrical connector 100 includes an insulative housing 1, a plurality of first and second terminals 2, 3 received in the housing 1 and a shell 6 covering the housing 1.

Figure 2:
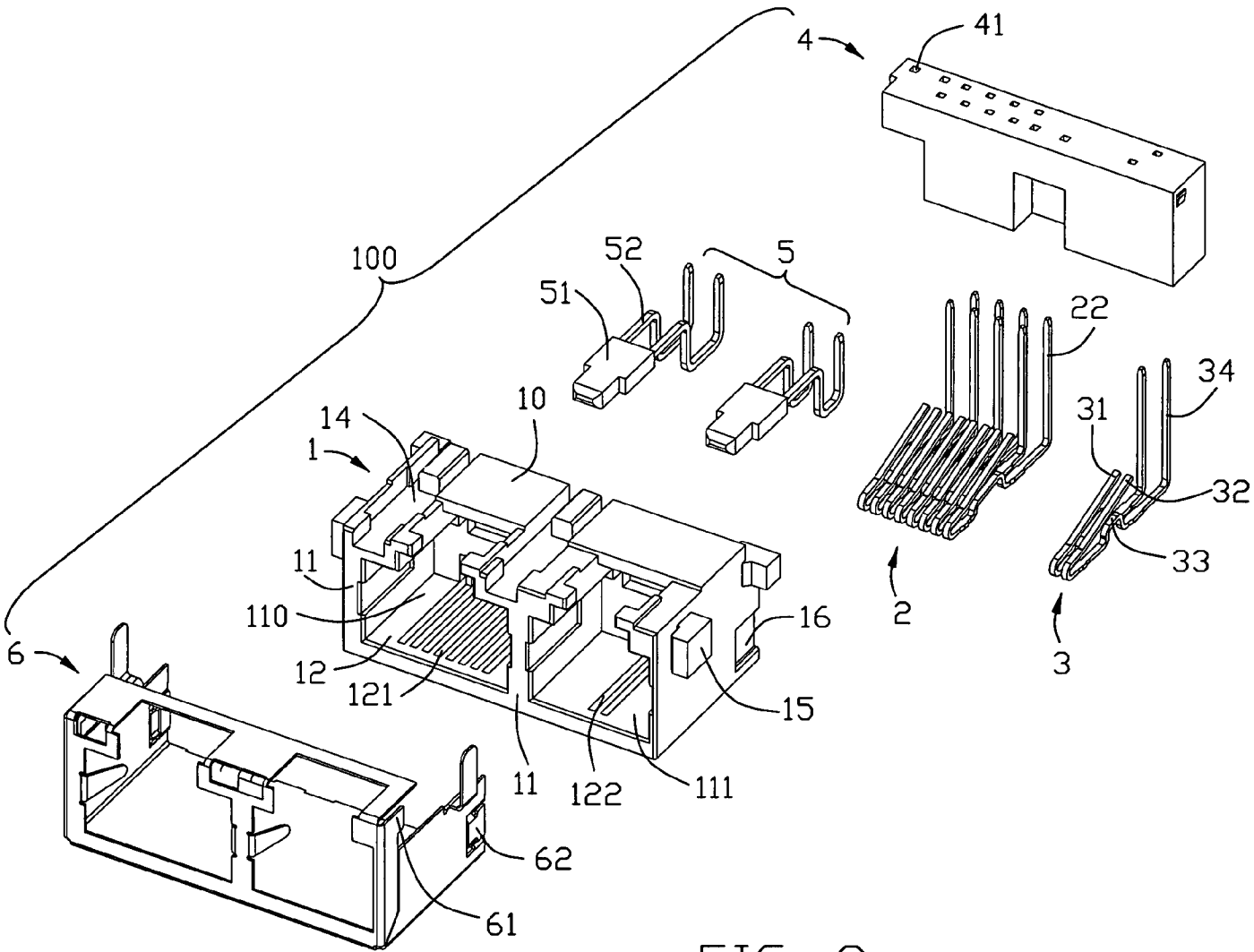
FIG. 2 is an exploded view of the electrical connector shown in FIG. 1.

Referring to FIG. 2, the insulative housing 1 defines a mounting face 10 and a mating face 11. The housing 1 defines a first receiving cavity 110 for receiving a RJ-45 plug and a second receiving cavity 111 align for receiving a smaller RJ-11 plug through the mating face 11 thereof. The housing 1 further defines a plurality of receiving grooves 121, 122 in communication with the receiving cavity 110, 111 for accommodating the terminals 2, 3 at a inner side 12 of the receiving cavity 110, 111 thereof along an inserting direction of a mating plug (not shown).

Figure 3:
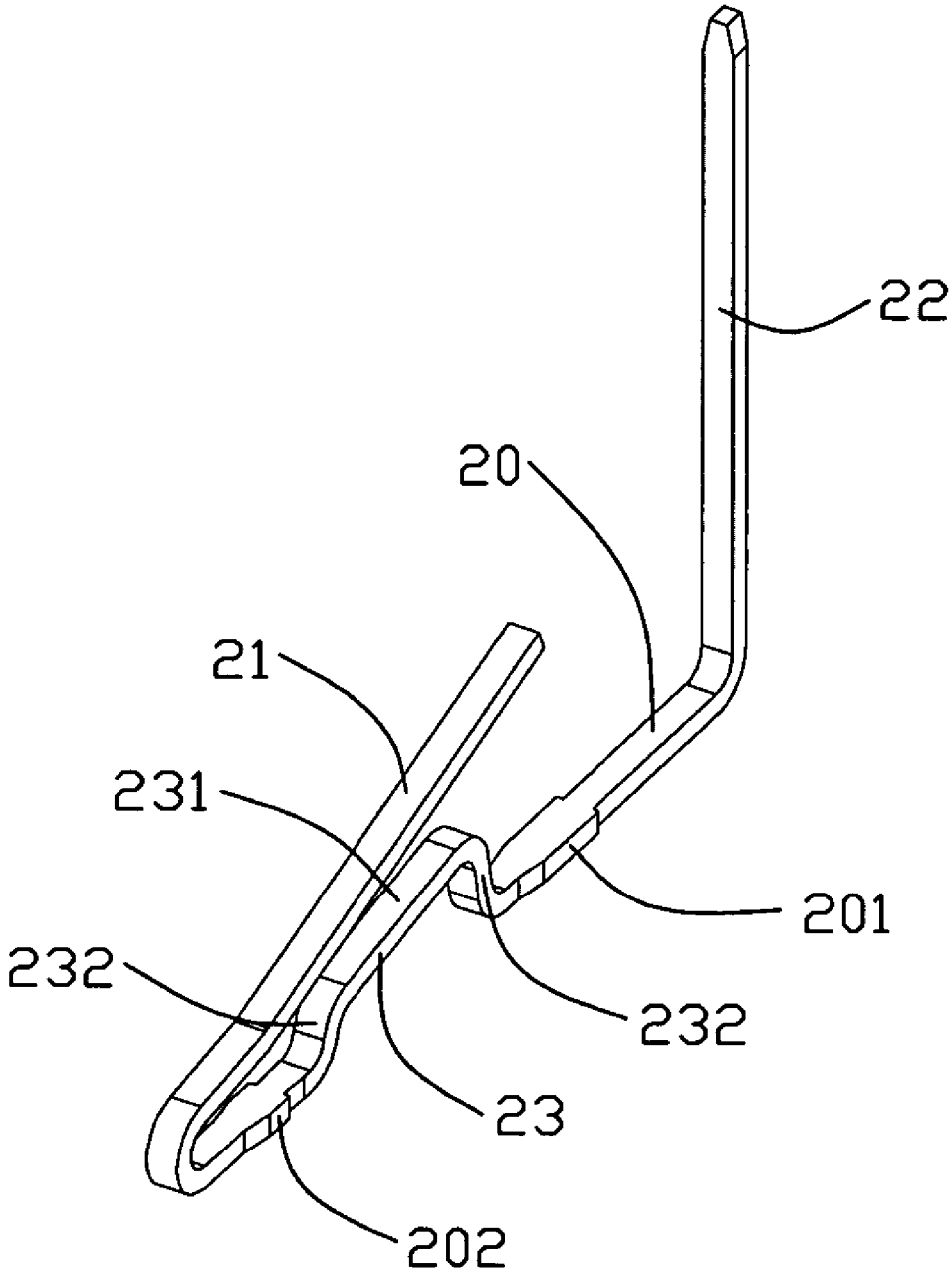
FIG. 3 is a perspective view of the first terminal of the electrical connector shown in FIG. 2.
Figure 4:
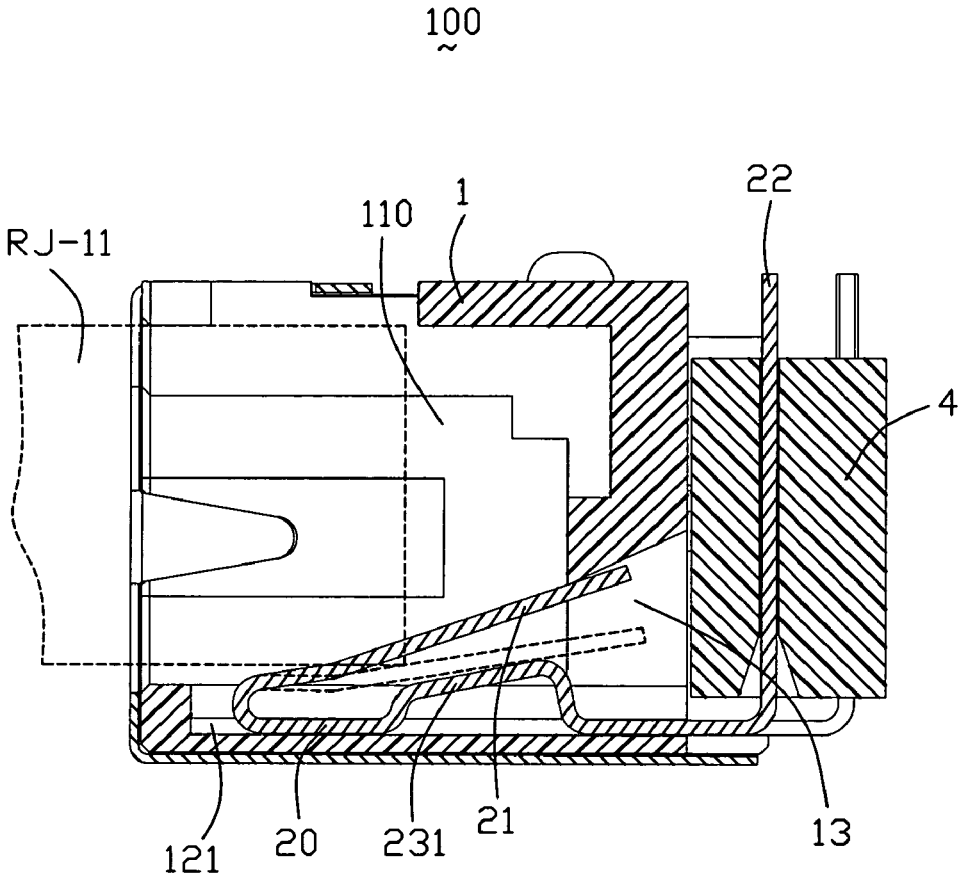
FIG. 4 is a cross sectional view taken along line 4-4 of FIG. 1, showing an improper insertion of an undersized mating connector.

Referring to FIG. 1 and FIG. 2, the first terminals 2 are received in the first receiving cavity 110, the second terminals 3 are received in the second receiving cavity 111. Referring to FIG. 3 and FIG. 4, each of the first terminals 2 defines a horizontal fixing portion 20 received in the receiving groove 121, an elastic contacting portion 21 extending rearwards at an acute angle from a front end of the fixing portion 20 and a soldering portion 22 extending vertically and upwardly from a rear end of the fixing portion 20. The fixing portion 20 defines an arched supporting portion 23 under the elastic contacting portion 21. The supporting portion 23 defines a supporting face 231 and two bend portions 232 at two ends of the supporting face 231. The bend portions 232 connect the supporting face 231 with the fixing portion 20, and two joints of the bend portions 232 and the fixing portion 20 are in the receiving groove 121. The supporting face 231 is slantwise relative to the fixing portion 20, and an acute angle is acted between. The fixing portion 20 further defines a plurality of protrusions 201, 202 beside the supporting portion 23. A contacting surface (as FIG. 4 shown) is formed therebetween when the elastic contacting portion 21 abut against the supporting portion 23. During assembly, the first terminals 2 are inserted into the housing 1 along a back-to-front direction through an opening 13 defined in a rear wall of the housing 1. Each fixing portion 20 is retained in the corresponding receiving groove 121 with the protrusions 201, 202 engaging with the receiving groove 121. The elastic contacting portions 21 extend upwardly and rearwards into the first receiving cavity 110 for engaging with a mating plug and with the free ends thereof blocked by the top of the opening 13. The soldering portions 22 extend out of the housing 1 and run through a retaining portion 4 upwardly.

The second terminals 3 includes a first contact 31 having the same configuration as the first terminals 2 and a second contact 32 defining a shorter supporting portion 33 along the inserting direction of the mating plug than the first terminals 2. The second terminals 3 are inserted into the second receiving cavity 111 along a back-to-front direction through the rear wall of the housing 1.

Figure 5:
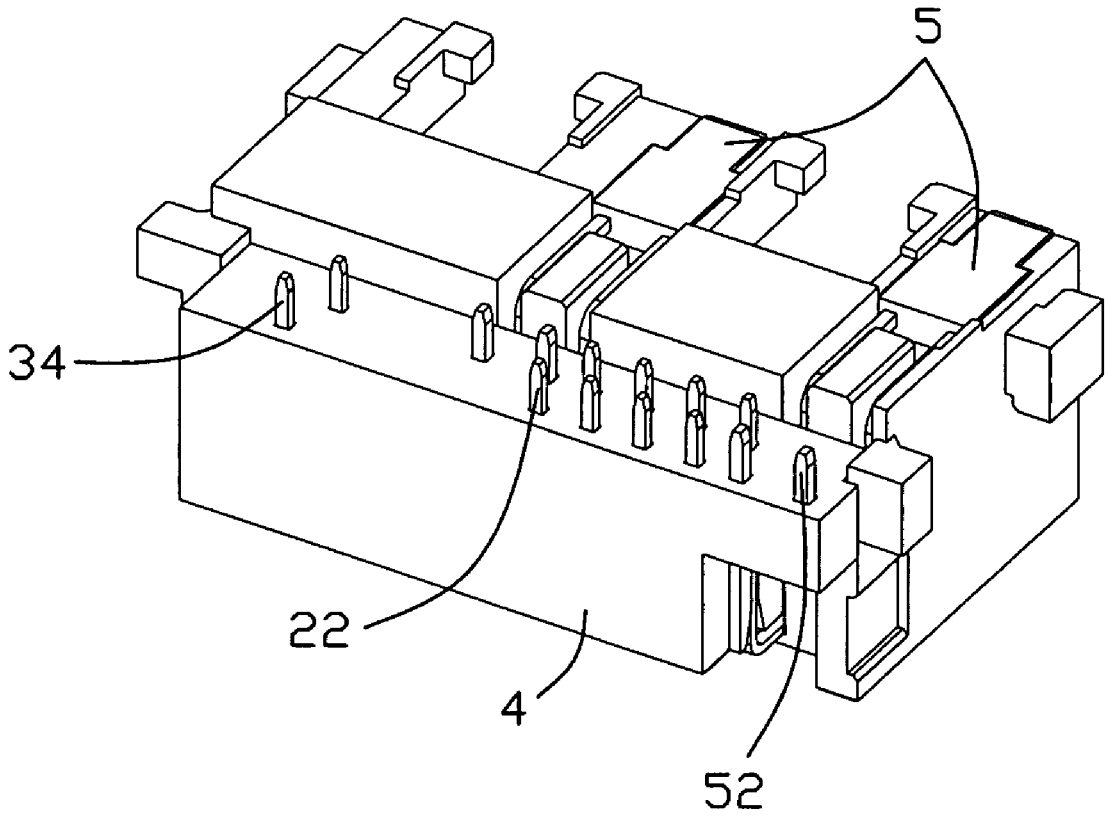
FIG. 5 is a perspective view of the electrical connector shown in FIG. 1 without the shell.

Referring to FIG. 2 and FIG. 5, the insulative housing 1 defines a pair of retaining slots 14 on the mounting face 10. A pair of Low Emitting Diodes 5 are received in the corresponding retaining slots 14. Each LED 5 defines an illuminant member 51 retained in the retaining slot 14 and a pair of soldering portions 52 running through the retaining portion 4 retained on the rear wall of the housing 1. The retaining portion 4 defines a plurality of slots 41. The soldering portions 22, 34 and 52 are all run through the retaining portion 4 from the corresponding slots 41 to prevent from being destroyed during assembly and soldering. The shell 6 covers on the housing 1 with a pair of retaining portions 61 being retained in retaining blocks 15 defined on the sidewall 14 of the housing 1, and a pair of elastic portions 62 abut against the indentation 16 (as FIG. 1 shown).

When a smaller RJ-11 plug is inserted into the first receiving cavity 110, the front end of the RJ-11 plug will hustle the elastic contacting portion 21 for a further entering, and the elastic contacting portion 21 will move downwardly until abut against the supporting face 231. The supporting of the supporting faces 231 may prevent the contacting portions 21 from further excursion to prevent the smaller RJ-11 plug from further entering into the first receiving cavity 110 (as FIG. 4 shown). The supporting portions 23 are strong enough to prevent an incorrect insertion of a smaller sized mating connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for permitting insertion of a full sized plug and preventing insertion of a smaller sized plug, comprising:

an insulative housing defining a receiving cavity through a mating face thereof for receiving a mating connector; and a plurality of terminals received in the housing, each terminal defining a fixing portion retained in the housing, a contacting portion being inclinedly bent at an angle and extending into the receiving cavity from one end of the fixing portion and a soldering portion extending from the other end of the fixing portion;

wherein the fixing portion further defines a supporting portion with two ends connecting with the fixing portion, the supporting portion faces to and supports the contacting portion to prevent the contacting portion from further excursion.

2. The electrical connector as described in claim 1, wherein the fixing portion is on a same level in the receiving cavity.

3. The electrical connector as described in claim 2, wherein the supporting portion is upwardly formed in the fixing portion and just under the contacting portion.

4. The electrical connector as described in claim 3, wherein the fixing portion defines a plurality of protrusions beside the supporting portion to retain the fixing portion on an inner surface of the receiving cavity.

5. The electrical connector as described in claim 2, wherein the supporting portion defines a supporting face, the supporting face and the fixing portion act an angle therebetween.

6. The electrical connector as described in claim 5, wherein a contacting face is formed therebetween when the contacting portion abut against the supporting face.

7. An electrical connector for preventing insertion of a smaller sized plug, comprising:

an insulative housing defining a receiving cavity through a mating face thereof and a plurality of receiving grooves at one inner side of the receiving cavity; and a plurality of terminals, each terminal defining a fixing portion received and retained in the receiving groove, a contacting portion extending into the receiving cavity, a soldering portion and a supporting portion bent upwardly at one portion of the fixing portion towards the contacting portion so as to prevent complete insertion of the smaller sized plug by the contacting portion abutting against the supporting portion;

wherein two joints of the supporting portion and the fixing portion are in the receiving groove.

8. The electrical connector as described in claim 7, wherein the supporting portion defines a supporting face and two bend portions at two ends of the supporting face, the bend portions connect the supporting face with the fixing portion and two joints of the bend portions and the fixing portion are in the receiving groove.

9. An electrical connector comprising:

an insulative housing defining a mating port;

a plurality of contacts disposed in the housing with respective cantilevered contacting sections obliquely extending into the mating port;

each of said contacts further including two spaced abutment sections abutting against an abutment face of the housing for positioning the corresponding contact in the housing, and a supporting section facing said mating port and spaced away from the abutment face with two respective ends respectively joined with said two abutment sections;

wherein the contacting section is spaced from the supporting section when no plug is inserted into the mating port while being seated upon said supporting section when a plug is inserted into the mating port.

10. The connector as claimed in claim 9, wherein said supporting section extends obliquely in rough compliance with the corresponding contacting section.

* * * * *